US009590335B1

(12) United States Patent
Ashibu

(10) Patent No.: US 9,590,335 B1
(45) Date of Patent: Mar. 7, 2017

(54) CONNECTOR

(71) Applicant: Japan Aviation Electronics Industry, Limited, Tokyo (JP)

(72) Inventor: Kenta Ashibu, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/171,565

(22) Filed: Jun. 2, 2016

(30) Foreign Application Priority Data

Sep. 3, 2015 (JP) ..... 2015-173819

(51) Int. Cl.

| | |
|---|---|
| ***H01R 13/62*** | (2006.01) |
| ***H01R 12/72*** | (2011.01) |
| ***H01R 13/629*** | (2006.01) |
| *H01R 12/88* | (2011.01) |
| *H01R 12/77* | (2011.01) |

(52) U.S. Cl.
CPC ..... *H01R 12/721* (2013.01); *H01R 13/62977* (2013.01); *H01R 12/774* (2013.01); *H01R 12/88* (2013.01)

(58) Field of Classification Search
CPC ..... H01R 12/774; H01R 12/88
See application file for complete search history.

(56) References Cited

U.S. PATENT DOCUMENTS 7,862,370 B1 * 1/2011 Chen ..... H01R 12/79 439/329
8,616,906 B2 * 12/2013 Iijima ..... H01R 12/88 439/260
2013/0280947 A1 10/2013 Matoba et al.

FOREIGN PATENT DOCUMENTS

JP 2013-196784 A 9/2013

* cited by examiner

*Primary Examiner* — Tho D Ta
(74) *Attorney, Agent, or Firm* — Muncy, Geissler, Olds & Lowe, P.C.

(57) ABSTRACT

A connector has a housing including an insertion portion, a recess-shaped shaft receiving portion opening in an opening direction and an abutment surface facing in an opposite direction from the opening direction, and an operation member held by the housing rotatably around an axis direction of a rotation shaft portion inserted in the shaft receiving portion, the operation member including a lock portion and a projection, as the operation member is brought to a closed position while a connection end portion of a connection target is inserted in the insertion portion, the lock portion is fitted in a lock receiving portion of the connection target to prohibit pull-out of the connection end portion of the connection target from the insertion portion, and the projection comes into contact with the abutment surface to prohibit movement of the operation member in the opening direction.

10 Claims, 8 Drawing Sheets

CONNECTOR

BACKGROUND OF THE INVENTION

The present invention relates to a connector, in particular, to a connector that may be connected to connection targets such as a flexible printed circuit (FPC), a flexible flat cable (FFC), a rigid circuit board and other printed wiring boards, the connection targets each comprising a sheet-like base on a surface of which a conductor pattern is disposed.

The FPC here refers to one in which conductive foil (mostly copper foil) is stuck to a flexible film-like insulator base (mostly polyimide), and the conductive foil is subjected to etching by means of lithographic technique to form wiring. The FFC refers to a cable in which flat-shaped conductors are disposed in an alignment and are covered by a sheet-like insulator. The rigid circuit board refers to one in which conductive foil (mostly copper foil) is stuck to a rigid insulator base (mostly glass epoxy), and the conductive foil is subjected to etching by means of lithographic technique to form wiring. Other printed wiring boards each refer to one in which a flexible film-like insulator base or rigid insulator base is provided with wiring through screen printing using a conductive ink.

As a connector of this type to be connected to a connection target, for example, JP 2013-196784A discloses a connector 3 that can be fitted with a connection target 1 by only a single action of inserting the connection target 1 into an insertion portion 2A of a housing 2, as illustrated in FIG. 12.

The housing 2 of the connector 3 is provided with an operation member 4. A rotation shaft portion that is formed so as to project from both ends of the operation member 4 is inserted in guide recess portions 2B formed in the housing 2 while holding portions 5A of contacts 5 are hooked on the operation member 4, whereby the operation member 4 is held by the housing 2 rotatably around the rotation shaft portion.

As illustrated in FIG. 13A, each actuation portion 4A that is integrally formed with the operation member 4 partially projects inside the insertion portion 2A of the housing 2. Accordingly, when the connection target 1 is inserted into the insertion portion 2A, the tip portion of the connection target 1 comes into contact with the actuation portion 4A of the operation member 4 and pushes the actuation portion 4A in the insertion direction of the connection target 1, whereby the operation member 4 rotates, as illustrated in FIG. 13B.

When the connection target 1 is further inserted into the insertion portion 2A while the operation member 4 has rotated in this manner, and each cutout 1A provided in the connection target 1 is located beneath the actuation portion 4A of the operation member 4, as illustrated in FIG. 13C, the operation member 4 that has rotated receives restoring force from the holding portions 5A of the contacts 5 and returns to the original position shown in FIG. 13A, whereby fitting between the connector and the connection target 1 is established. In this process, the actuation portion 4A of the operation member 4 is inserted into the cutout 1A of the connection target 1, resulting in prevention of the connection target 1 from falling off the connector 3.

However, as illustrated in FIG. 13C, even with the actuation portion 4A of the operation member 4 being inserted into the cutout 1A of the connection target 1, if the connection target 1 is applied with a large withdrawal force that pulls the connection target 1 out from the connector 3, the cutout 1A of the connection target 1 would generate a pushing force to push the actuation portion 4A of the operation member 4 upward.

Since the guide recess portions 2B of the housing 2 open upward as shown in FIG. 12, the pushing force applied to the actuation portion 4A pushes the operation member 4 upward, causing not only the connection target 1 to be pulled out from the connector 3 but also the operation member 4 to possibly come off the housing 2 upward. If the operation member 4 comes off the housing 2, the contacts 5 hooked on the operation member 4 may deform beyond their elastic region, and the connector 3 may be damaged and become no longer usable.

SUMMARY OF THE INVENTION

The present invention has been made in order to solve the conventional problem described above and an object of the present invention is to provide a connector capable of maintaining connection with a connection target even if a withdrawal force is applied to the fitted connection target.

A connector according to the present invention comprises:

a housing including an insertion portion into which a connection end portion of a connection target is inserted, a shaft receiving portion having a recess-like shape and opening in an opening direction which crosses an insertion direction of the connection target and an abutment surface facing in an opposite direction from the opening direction of the shaft receiving portion, and an operation member including a rotation shaft portion to be inserted in the shaft receiving portion and being held by the housing rotatably around an axis direction of the rotation shaft portion, wherein the operation member includes a lock portion projecting in an orthogonal direction to the axis direction of the rotation shaft portion and a projection projecting in another orthogonal direction to the axis direction of the rotation shaft portion than the orthogonal direction in which the lock portion projects, wherein the connection end portion of the connection target is allowed to be inserted into or pulled out from the insertion portion when the operation member is located at an open position, and wherein, as the operation member is brought to a closed position while the connection end portion of the connection target is inserted in the insertion portion, the lock portion is fitted in a lock receiving portion of the connection target to prohibit pull-out of the connection end portion of the connection target from the insertion portion, and the projection comes into contact with or in vicinity of the abutment surface to prohibit movement of the operation member in the opening direction.

DETAILED DESCRIPTION OF THE INVENTION

An embodiment of the present invention will be described below based on the appended drawings.

Figure 1:
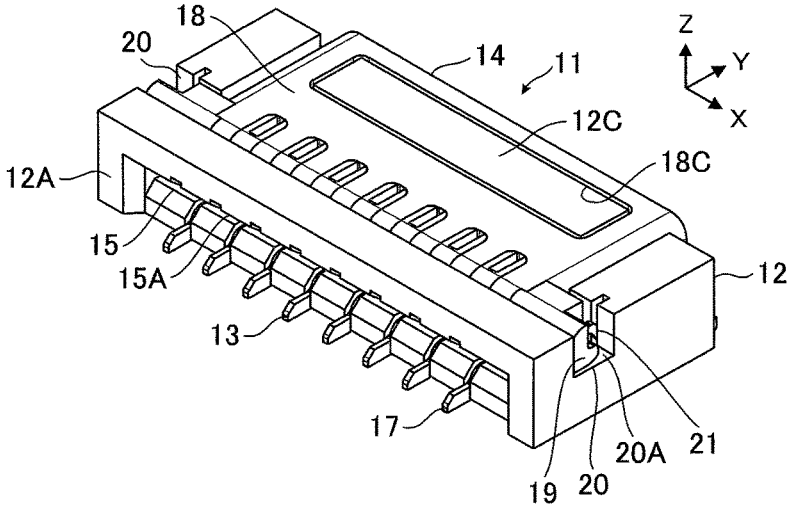
FIG. 1 is a perspective view showing a connector according to an embodiment of the present invention when viewed obliquely from the front.
Figure 2:
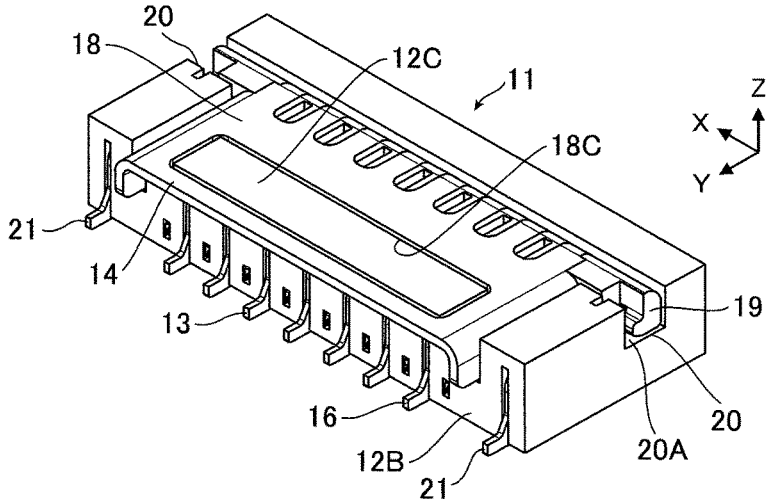
FIG. 2 is a perspective view showing the connector according to the embodiment when viewed obliquely from the rear.

FIGS. 1 and 2 show the structure of a connector 11 according to the embodiment. The connector 11 is a small connector for connection with connection targets such as a flexible printed circuit (FPC), a flexible flat cable (FFC), a rigid circuit board, and other printed wiring boards, the connection targets each having a sheet-like base on a surface of which a conductive pattern is disposed. The connector 11 includes a housing 12 having a substantially cuboid outer shape elongated in the width direction, a plurality of contacts 13 arranged in the width direction of the housing 12 and extending from the front surface 12A side of the housing 12 toward the rear surface 12B side, and an operation member 14 attached to the housing 12.

The housing 12 is provided with a recess-like insertion portion 15, and an insertion opening 15A of the insertion portion 15 opens toward the front surface 12A side of the housing 12. The connector is designed such that a connection target (not shown) is inserted into the insertion portion 15 through the insertion opening 15A of the insertion portion 15.

The plurality of contacts 13 are composed of first contacts 16 and second contacts 17 that are alternately arranged, each of the first contacts 16 being partially exposed on the rear surface 12B side of the housing 12, and each of the second contacts 17 being partially exposed on the front surface 12A side of the housing 12.

For convenience, the direction in which the contacts 13 are arranged is referred to as X direction, the direction from the front surface 12A side toward the rear surface 12B side of the housing 12 as +Y direction, and the direction from the bottom toward the top of the housing 12 as +Z direction.

The operation member 14 includes a substantially rectangular plate-like manipulation portion 18 that can cover the upper part of the housing 12 and a rotation shaft portion 19 formed integrally with the manipulation portion 18. The rotation shaft portion 19 is connected to the end part of the manipulation portion 18 in the −Y direction and extends in the X direction. Both ends of the rotation shaft portion 19 in the X direction project from the manipulation portion 18 in the +X direction and the −X direction, respectively, and are inserted in a pair of recess-like shaft receiving portions 20 formed in the housing 12. Each of the pair of shaft receiving portions 20 opens in the X direction and the +Z direction. As the operation member 14 is moved from the +Z direction to the −Z direction, both ends of the rotation shaft portion 19 can be inserted in the corresponding shaft receiving portions 20, respectively. Each of the shaft receiving portions 20 has a flat bottom portion 20A extending along the XY plane.

The operation member 14 is held in the housing 12 in such a manner that through rotation of both ends of the rotation shaft portion 19 in the pair of shaft receiving portions 20, the operation member 14 can be rotated within a rotation angle range of substantially 90 degrees from a closed position where the manipulation portion 18 covers the upper part of the housing 12, via an open position where an end of the manipulation portion 18 on the +Y direction side is apart from the upper part of the housing 12 in the +Z direction, to a fully open position which is farther on the opposite side from the closed position than the open position and in which the manipulation portion 18 stands substantially perpendicularly to the upper part of the housing 12. FIGS. 1 and 2 illustrate the connector 11 having the operation member 14 located at the closed position.

In addition, a pair of torque members 21 corresponding to the pair of shaft receiving portions 20 are held by the housing 12. The torque members 21 are in contact with the ends in the X direction of the rotation shaft portion 19 that are inserted in the shaft receiving portions 20 and exert a torque on the operation member 14 for movement from the open position toward the closed position.

Figure 3A:
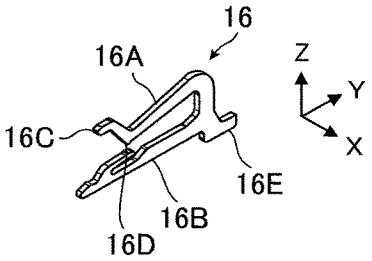
FIG. 3A is a perspective view showing a first contact used in the connector according to the embodiment.

As illustrated in FIG. 3A, the first contact 16 includes an upper arm portion 16A and a lower arm portion 16B, the upper and lower arm portions 16A and 16B each extending in the Y direction with their ends in the +Y direction connected to each other in the Z direction, and has spring properties. The upper arm portion 16A is provided at its end in the −Y direction with a tip portion 16C that comes into contact with the rotation shaft portion 19 of the operation member 14, and, at a position away from the tip portion 16C in the +Y direction, provided with a contact portion 16D that projects in the −Z direction. The lower arm portion 16B is provided at its end in the +Y direction with a board connection portion 16E for connection with a connection pad of a board (not shown) on which the connector 11 is to be mounted and the board connection portion 16E is exposed from the housing 12 on the rear surface 12B side.

Figure 3B:
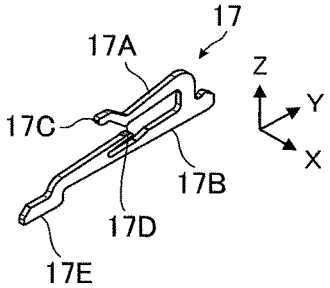
FIG. 3B is a perspective view showing a second contact used in the connector according to the embodiment.

As illustrated in FIG. 3B, the second contact 17 includes an upper arm portion 17A and a lower arm portion 17B, the upper and lower arm portions 17A and 17B each extending in the Y direction with their ends in the +Y direction connected to each other in the Z direction, and has spring properties. The upper arm portion 17A is provided at its end in the −Y direction with a tip portion 17C that comes into contact with the rotation shaft portion 19 of the operation member 14, and, at a position away from the tip portion 17C in the +Y direction, provided with a contact portion 17D that projects in the −Z direction. The lower arm portion 17B is provided at its end in the −Y direction with a board connection portion 17E for connection with a connection pad of a board (not shown) on which the connector 11 is to be mounted and the board connection portion 17E is exposed from the housing 12 on the front surface 12A side.

Figure 4:
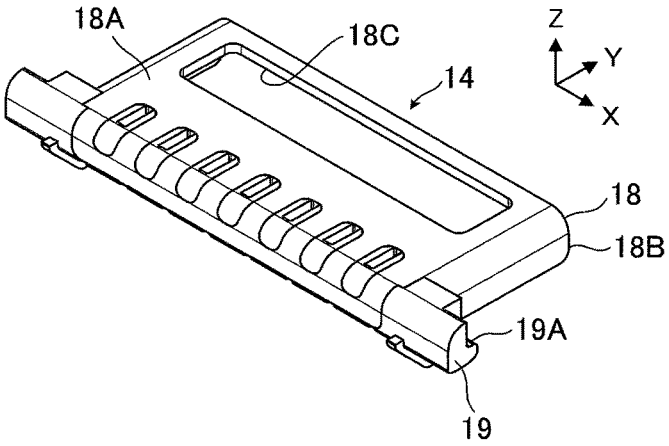
FIG. 4 is a perspective view showing an operation member used in the connector according to the embodiment.

As illustrated in FIG. 4, the rotation shaft portion 19 of the operation member 14 is provided at both ends thereof, respectively, with step portions 19A with which the corresponding torque members 21 come into contact and which face in the +Z direction.

The manipulation portion 18 includes a manipulation portion body 18A in a flat plate shape and a pair of bent portions 18B each being bent into a right angle with respect to the manipulation portion body 18A from the ends of the manipulation portion body 18A in the +X direction and in the −X direction. The manipulation portion body 18A is provided with an opening portion 18C in a substantially rectangular shape extending in the X direction.

Figure 5:
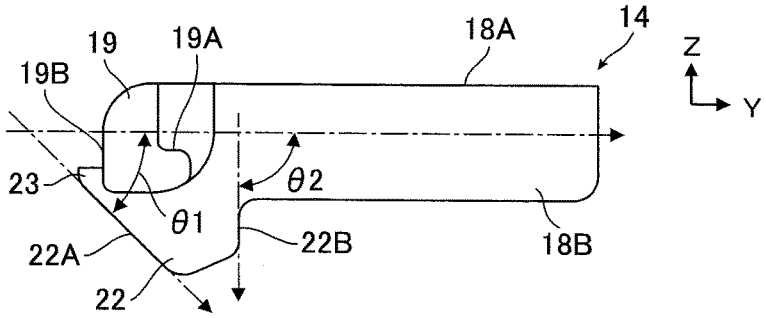
FIG. 5 is a lateral view of the operation member.

As illustrated in FIG. 5, each of the bent portions 18B is provided with a lock portion 22 projecting in the −Z direction orthogonal to the X direction that is the axial direction of the rotation shaft portion 19 and a projection 23 projecting in the −Y direction orthogonal to the X direction that is the axial direction of the rotation shaft portion 19 when the operation member 14 is located at the closed position, and the manipulation portion body 18A is located on the XY plane.

The lock portion 22 has a push-in surface 22A facing in the −Y direction and in the −Z direction and a lock surface 22B facing in the +Y direction. When the operation member 14 is located at the closed position, an angle θ1 between the +Y direction that is the insertion direction of the connection target (not shown) and the push-in surface 22A is set to have a value smaller than 90 degrees, while an angle θ2 between the +Y direction and the lock surface 22B is set to have a value not smaller than 90 degrees.

The projection 23 is disposed adjacent to the lock portion 22 on the −Y direction side.

The manipulation portion 18, the lock portion 22 and the projection 23 as above are integrally formed as a single metal member and can be formed through the process of punching out and bending a single metal plate. Through the insert-molding using the metal member, the operation member 14 in which the rotation shaft portion 19 is integrated with the metal member can be formed.

The rotation shaft portion 19 is provided at both ends thereof respectively with flat portions 19B that face in the −Y direction and extend along the XZ plane when the operation member 14 is located at the closed position.

Figure 6:
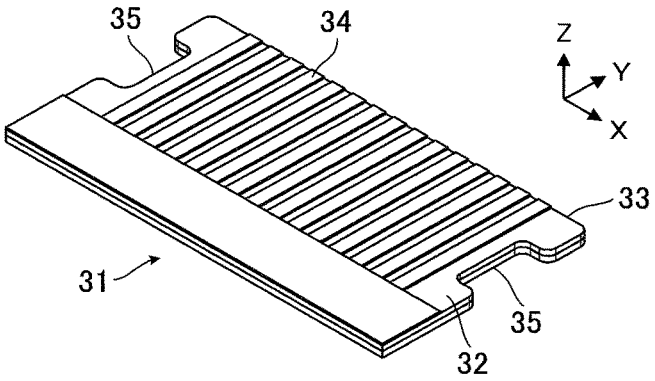
FIG. 6 is a perspective view showing a connection target.

FIG. 6 illustrates a connection target 31 to be fitted with the connector 11. The connection target 31 is composed of an FPC, for example, and has a structure in which a conductor pattern is formed on a sheet-like insulation base 32. On a surface of a connection end portion 33 to be connected with the connector 11, a plurality of electrodes 34 formed of the conductor pattern are arranged in the X direction and exposed. The electrodes 34 are arranged at the same pitch as that of the contacts 13 of the connector 11.

The connection end portion 33 of the connection target 31 is provided at the both ends thereof respectively with cutouts 35 as the lock receiving portions. The cutouts 35 are disposed at the positions corresponding in the X direction to the lock portions 22 of the operation member 14 when the connection end portion 33 of the connection target 31 is inserted into the insertion portion 15 of the connector 11.

Next, the operation for fitting the connection target 31 with the connector 11 will be described.

Figure 7A:
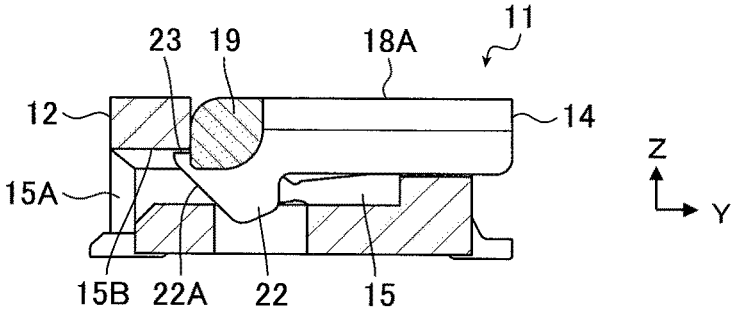
FIGS. 7A to 7D are a lateral cross-sectional view taken along a lock portion, a lateral cross-sectional view taken along the first contact, a lateral cross-sectional view taken along the second contact, and a lateral cross-sectional view taken along a torque member, respectively, each showing the connector according to the embodiment prior to fitting with the connection target.
Figure 7B:
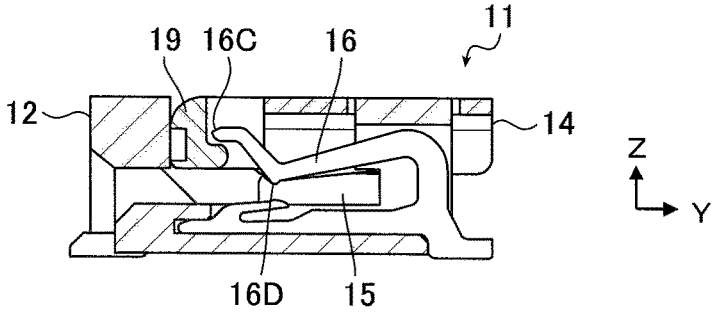
Figure 7C:
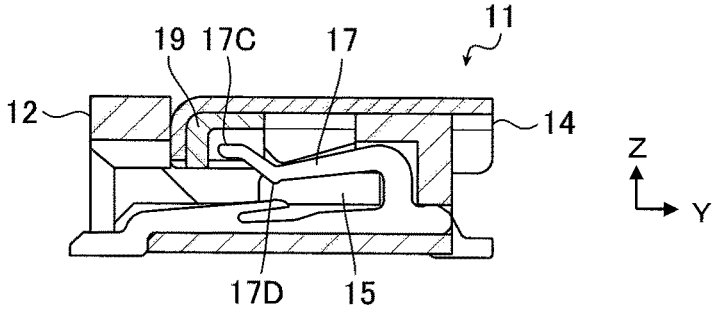
Figure 7D:
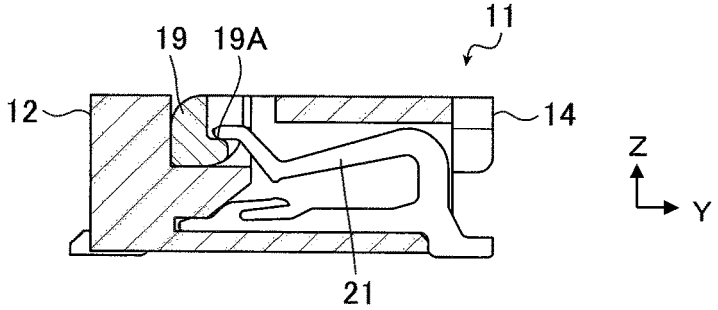

Before fitting with the connection target 31, as illustrated in FIG. 7D, the tip portion of the torque member 21 held by the housing 12 applies a force in the −Z direction on the step portion 19A of the rotation shaft portion 19 of the operation member 14, whereby the operation member 14 is located at the closed position to cover the upper part of the housing 12 with the manipulation portion body 18A as illustrated in FIG. 7A.

At this time, the lock portion 22 of the operation member 14 extends across the insertion portion 15 of the housing 12 in the Z direction, the push-in surface 22A of the lock portion 22 opposes the insertion opening 15A of the insertion portion 15, and the projection 23 is in contact with or in vicinity of a ceiling surface 15B of the insertion portion 15 of the housing 12. The ceiling surface 15B of the insertion portion 15 forms an abutment surface which the projection 23 abuts.

In addition, as illustrated in FIGS. 7B and 7C, the tip portion 16C of the first contact 16 and the tip portion 17C of the second contact 17 are not in contact with the rotation shaft portion 19 of the operation member 14, and the contact portion 16D of the first contact 16 and the contact portion 17D of the second contact 17 project inside the insertion portion 15.

Figure 8A:
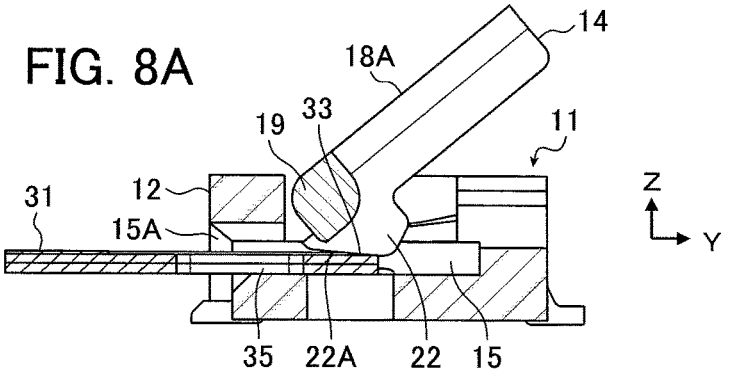
FIGS. 8A to 8D are a lateral cross-sectional view taken along the lock portion, a lateral cross-sectional view taken along the first contact, a lateral cross-sectional view taken along the second contact, and a lateral cross-sectional view taken along the torque member, respectively, each showing the connector according to the embodiment in the process of fitting with the connection target.

As the connection end portion 33 of the connection target 31 is inserted into the insertion portion 15 through the insertion opening 15A in the +Y direction, as illustrated in FIG. 8A, the tip end face in the +Y direction of the connection end portion 33 comes into contact with the push-in surface 22A of the lock portion 22 of the operation member 14 and pushes the push-in surface 22A in the +Y direction, whereby the operation member 14 starts rotating toward the open position so that the manipulation portion body 18A moves apart from the upper part of the housing 12. Here, each of the cutouts 35 of the connection end portion 33 of the connection target 31 is still located away from the lock portion 22 of the operation member 14 on the −Y direction side.

Figure 8B:
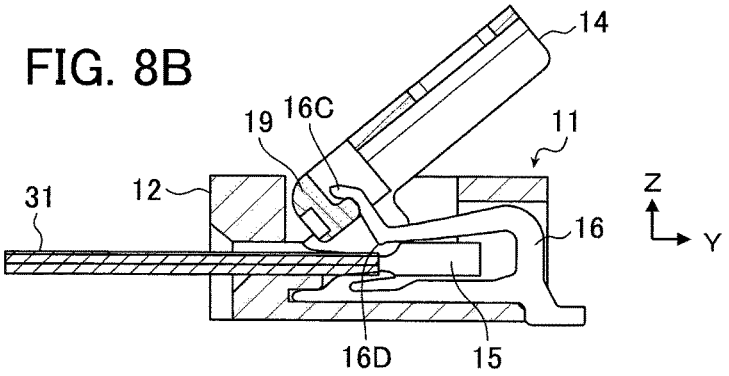
Figure 8C:
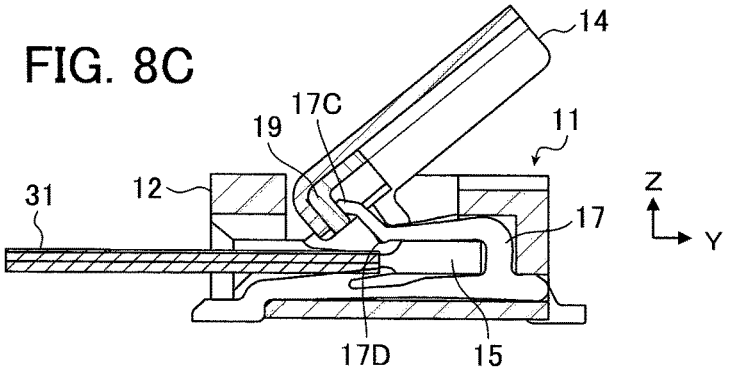
Figure 8D:
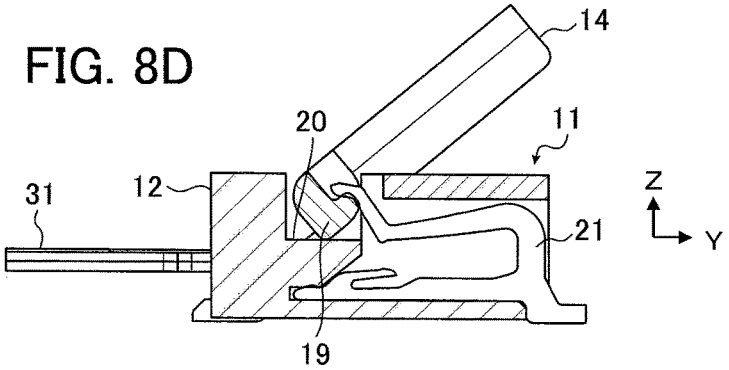

As illustrated in FIG. 8D, both ends of the rotation shaft portion 19 of the operation member 14 each rotate in the shaft receiving portion 20 of the housing 12, while the torque members 21 exert a torque on the operation member 14 for returning to the closed position.

At this time, as illustrated in FIGS. 8B and 8C, the tip portion 16C of the first contact 16 and the tip portion 17C of the second contact 17 are in contact with and are pulled up in the +Z direction by the rotation shaft portion 19 of the operation member 14, whereby the contact portion 16D of the first contact 16 and the contact portion 17D of the second contact 17 are located away in the +Z direction from the insertion portion 15.

When the operation member 14 is located at the open position as illustrated in FIGS. 8A to 8D as described above, the connection end portion 33 of the connection target 31 is allowed to be inserted into the insertion potion 15.

Figure 9A:
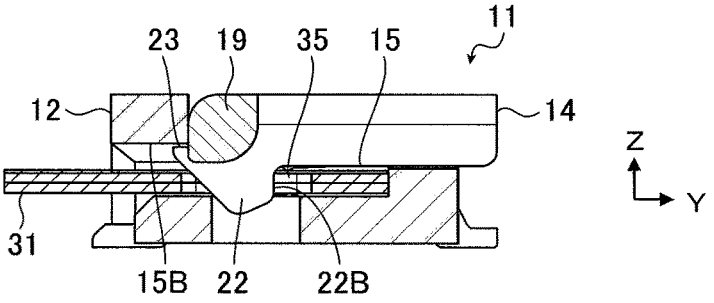
FIGS. 9A to 9D are a lateral cross-sectional view taken along the lock portion, a lateral cross-sectional view taken along the first contact, a lateral cross-sectional view taken along the second contact, and a lateral cross-sectional view taken along the torque member, respectively, each showing the connector according to the embodiment at the completion of fitting with the connection target.

Then, as the connection end portion 33 of the connection target 31 is further inserted in the +Y direction, each of the cutouts 35 of the connection target 31 reaches the lock portion 22 of the operation member 14, causing the torque member 21 to exert a torque on the rotation shaft portion 19 of the operation member 14. Hence, as illustrated in FIG. 9A, the operation member 14 rotates in the opposite direction to the preceding rotation to return to the closed position. Accordingly, the lock portion 22 of the operation member 14 is fitted in the cutout 35 of the connection end portion 33 of the connection target 31.

Figure 9B:
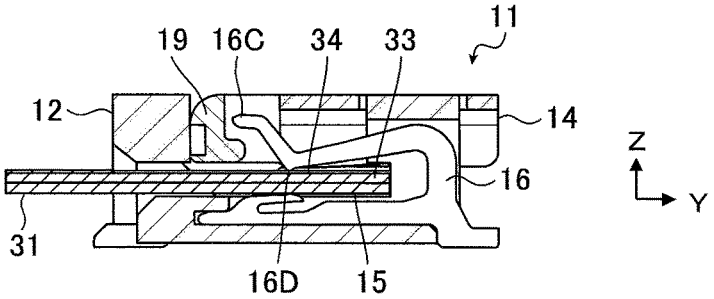
Figure 9C:
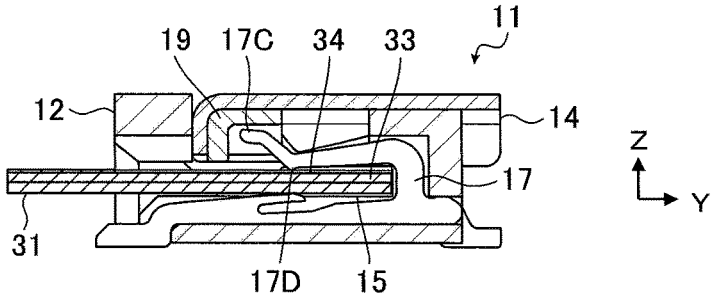
Figure 9D:
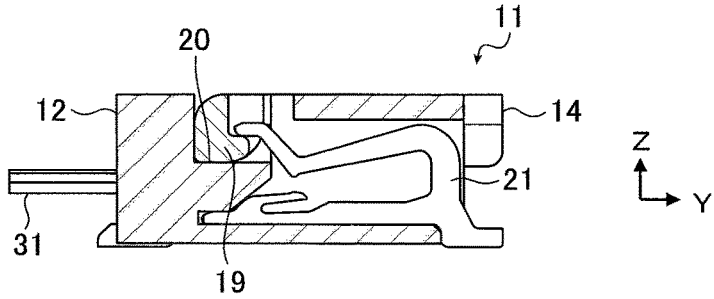

Since the operation member 14 returns to the closed position, as illustrated in FIG. 9D, the torque member 21 is brought back to the state before fitting with the connection target 31.

In this process, as illustrated in FIGS. 9B and 9C, the rotation shaft portion 19 of the operation member 14 is separated from the tip portion 16C of the first contact 16 and the tip portion 17C of the second contact 17, while, due to the spring properties of the first and second contacts 16 and 17, the contact portion 16D of the first contact 16 and the contact portion 17D of the second contact 17 are pressed against the corresponding electrode 34 of the connection end portion 33 of the connection target 31 that is inserted into the insertion portion 15, thereby establishing electrical connection.

As above, with the operation member 14 being located at the closed position, the fitting operation of the connection target 31 with the connector 11 can be completed only by a single action of inserting the connection end portion 33 of the connection target 31 into the insertion portion 15 through the insertion opening 15A.

At this time, since the lock portions 22 of the operation member 14 are fitted in the cutouts 35 of the connection end portion 33 of the connection target 31, even if the connection end portion 33 of the connection target 31 is pulled out from the insertion portion 15, the cutouts 35 would be hooked on the lock surfaces 22B of the lock portions 22, prohibiting the pull-out of the connection target 31.

Assuming that the connection target 31 is applied with the even stronger withdrawal force to forcibly pull the connection target 31 out the connector 11, the cutouts 35 of the connection target 31 would possibly generate a force to push the lock portions 22 of the operation member 14 up in the +Z direction since the angle θ2 between the +Y direction that is the insertion direction of the connection target 31 and each of the lock surfaces 22B is set to have a value not smaller than 90 degrees. Since both ends of the rotation shaft portion 19 of the operation member 14 are inserted in the shaft receiving portions 20 opening in the +Z direction, movement of the operation member 14 in the +Z direction cannot be prohibited by the shaft receiving portions 20 of the housing 12.

However, when the operation member 14 is located at the closed position, the projections 23 of the operation member 14 are in contact with or in vicinity of the ceiling surface 15B of the insertion portion 15 of the housing 12. Hence, even if the lock portions 22 are applied with a pushing force up in the +Z direction, the projections 23 abut and are caught by the ceiling surface 15B of the insertion portion 15 of the housing 12 so that movement of the operation member 14 in the +Z direction can be prohibited. If the projections 23 are in contact with the ceiling surface 15B of the insertion portion 15 when the operation member 14 is located at the closed position, the operation member 14 does not move in the +Z direction. Even if the projections 23 are in vicinity of the ceiling surface 15B of the insertion portion 15 when the operation member 14 is located at the closed position, the operation member 14 slightly moves until the projections 23 come into contact with the ceiling surface 15B of the insertion portion 15, and then its movement in the +Z direction will be prohibited.

Therefore, even if the connection target 31 fitted with the connector 11 is applied with a withdrawal force, the connection target 31 is prevented from being pulled out, and the connector 11 can be prevented from being damaged due to the movement of the operation member 14 in the +Z direction, thereby enabling to maintain connection with the connection target 31.

Subsequently, an operation to pull out the connection target 31 fitted with the connector 11 from the connector 11 will be described.

Figure 10A:
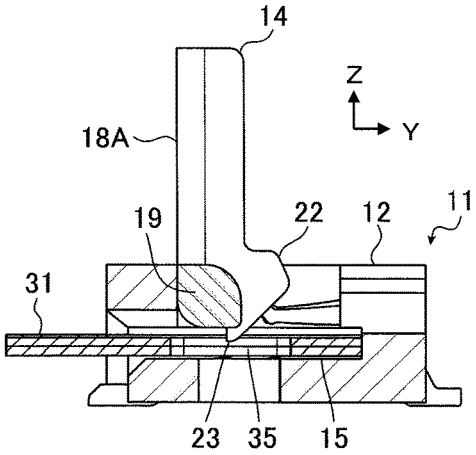
FIGS. 10A to 10D are a lateral cross-sectional view taken along the lock portion, a lateral cross-sectional view taken along the first contact, a lateral cross-sectional view taken along the second contact, and a lateral cross-sectional view taken along the torque member, respectively, each showing the connector according to the embodiment when pull-out of the connection target starts.

First, when the connection target 31 is pulled out, as illustrated in FIG. 10A, the operation member 14 is rotated to the fully open position that is farther in the opposite direction from the closed position than the open position as illustrated in FIGS. 8A to 8D. That is, the operation member 14 is rotated until the manipulation portion body 18A comes on the XZ plane and abuts the housing 12, thereby standing substantially perpendicularly to the upper part of the housing 12. In this manner, the lock portions 22 of the operation member 14 come off the cutouts 35 of the connection target 31 in the +Z direction, but the projections 23 of the operation member 14 project into the insertion portion 15 of the housing 12 so as to be located inside the cutouts 35 of the connection target 31.

Figure 10B:
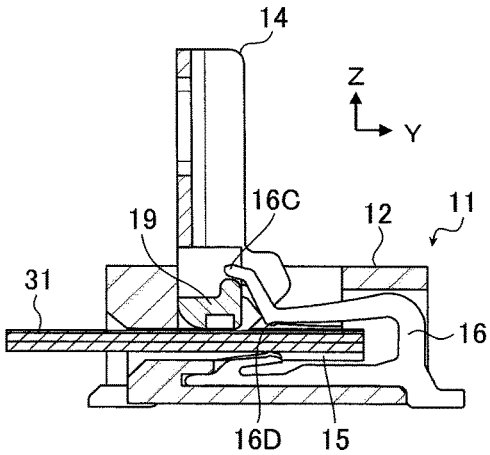
Figure 10C:
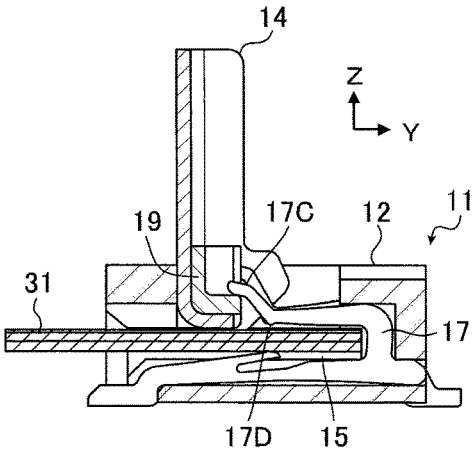
Figure 10D:
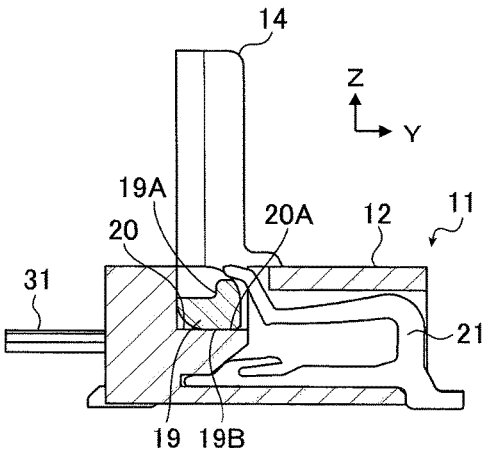

At this time, as illustrated in FIG. 10D, the tip portion of each of the torque members 21 comes off the step portion 19A of the rotation shaft portion 19 of the rotation member 14, the torque member 21 applies a force of pushing the rotation shaft portion 19 in the −Z direction without causing the rotation shaft portion 19 to generate a torque. In addition, when the operation member 14 is located at the closed position, the flat portions 19B of the rotation shaft portion 19 each face in the −Y direction and extend along the XZ plane, whereas, if the operation member 14 is rotated to the fully open position, the flat portions 19B of the rotation shaft portion 19 each face in the −Z direction and extend along the XY plane.

Accordingly, the flat portions 19B of the rotation shaft portion 19 are located on the flat bottom portions 20A of the shaft receiving portions 20, and the operation member 14 is maintained stably at the fully open position.

At this time, as illustrated in FIGS. 10B and 10C, the tip portion 16C of the first contact 16 and the tip portion 17C of the second contact 17 come into contact with and are pulled up in the +Z direction by the rotation shaft portion 19 of the operation member 14, whereby the contact portion 16D of the first contact 16 and the contact portion 17D of the second contact 17 are away in the +Z direction from the insertion portion 15.

Figure 11A:
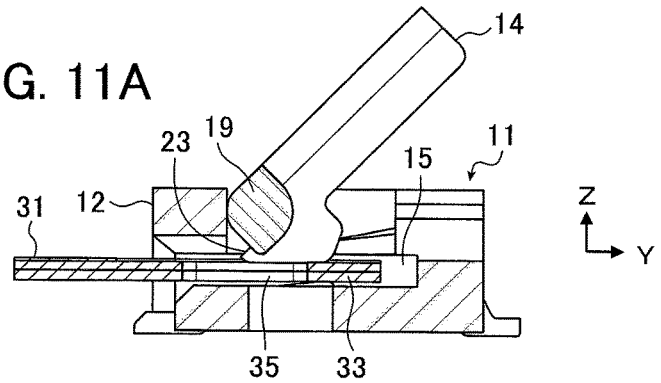
FIGS. 11A to 11D are a lateral cross-sectional view taken along the lock portion, a lateral cross-sectional view taken along the first contact, a lateral cross-sectional view taken along the second contact, and a lateral cross-sectional view taken along the torque member, respectively, each showing the connector according to the embodiment in the process of pull-out of the connection target.

If the connection target 31 is pulled out from the connector 11 in this state, the cutouts 35 of the connection target 31 are hooked on the projections 23 of the operation member 14, whereby the operation member 14 rotates toward the closed position as illustrated in FIG. 11A. The operation member 14 is rotated until the projections 23 of the operation member 14 exit from the insertion portion 15 in the +Z direction, whereby the connection end portion 33 of the connection target 31 can be pulled out from the insertion portion 15.

Figure 11B:
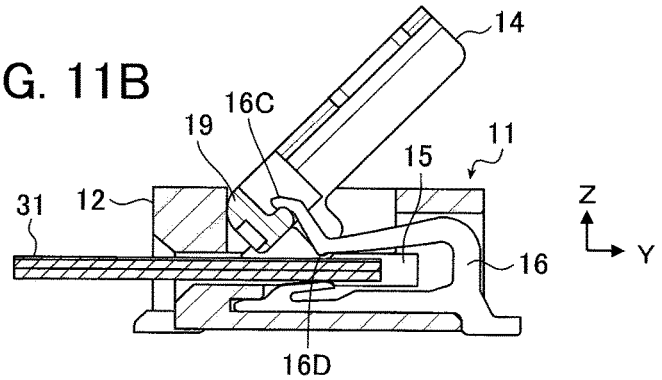
Figure 11C:
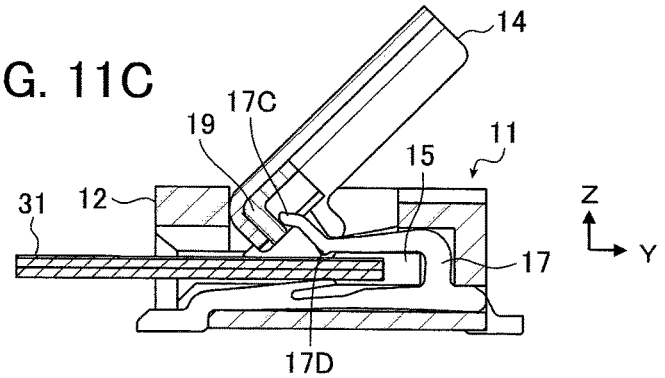
Figure 11D:
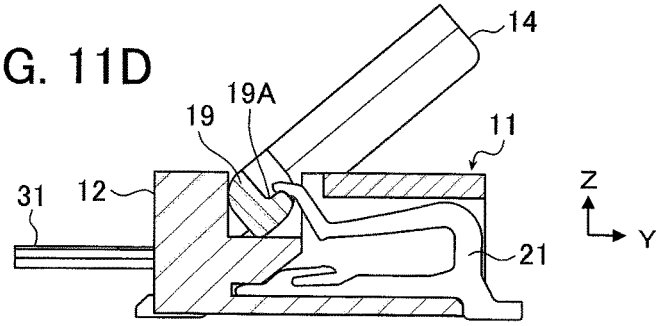
Figure 12:
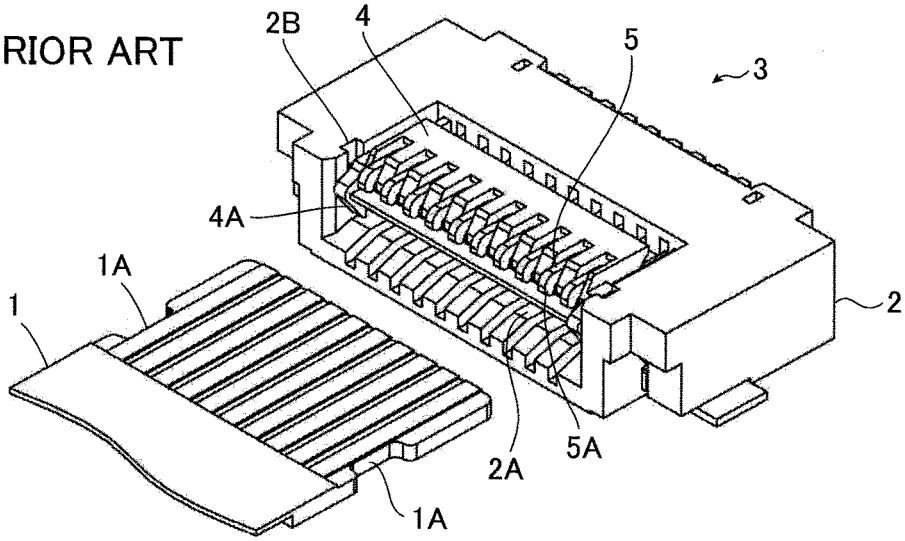
FIG. 12 PRIOR ART
FIG. 12 is a perspective view showing a conventional connector.
Figure 13A:
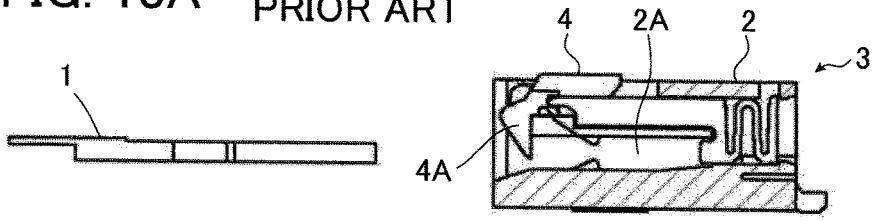
FIG. 13A PRIOR ART
FIG. 13A to 13C are lateral cross-sectional views showing in a stepwise fashion the conventional connector with which a connection target is to be fitted.
Figure 13B:
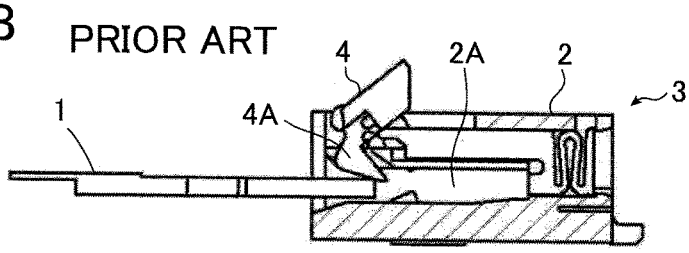
FIG. 13B PRIOR ART
Figure 13C:
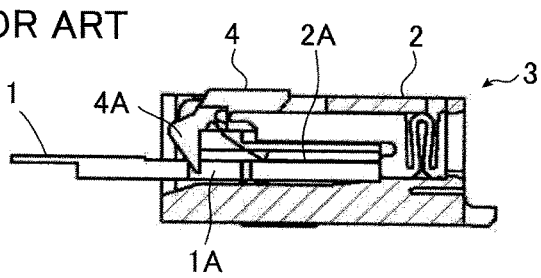
FIG. 13C PRIOR ART

In this state, as illustrated in FIG. 11D, the torque member 21 exerts a torque on the rotation shaft portion 19 of the operation member 14 for returning the operation member 14 to the closed position.

As illustrated in FIGS. 11B and 11C, the tip portion 16C of the first contact 16 and the tip portion 17C of the second contact 17 are maintained as being pulled up in the +Z direction by the rotation shaft portion 19 of the operation member 14.

When the connection end portion 33 of the connection target 31 is thoroughly pulled out from the insertion portion 15, due to the torque exerted on the step portion 19A of the rotation shaft portion 19 by the torque member 21, the operation member 14 rotates to the closed position, and the connector 11 returns to the state as illustrated in FIGS. 7A to 7D.

As illustrated in FIG. 10A, the operation member 14 cannot be opened wider than the fully open position where the manipulation portion body 18A is located on the XZ plane and abuts the housing 12, and when the operation member 14 is located at the fully open position, the projections 23 project inside the insertion portion 15 of the housing 12. Hence, for fitting the connection target 31 with the connector 11, even if the connection target 31 is to be inserted into the insertion portion 15 with the operation member 14 being wrongly located at the fully open position, the tip end of the connection end portion 33 of the connection target 31 abuts the projections 23 projecting inside the insertion portion 15, thereby preventing the connection target 31 from being inserted.

Accordingly, when the operation member 14 is located at the fully open position, wrong insertion of the connection target 31 can be avoided, ensuring the fitting operation by a single action in the state where the operation member 14 is located at the closed position.

In addition, as illustrated in FIG. 4, the manipulation portion 18 of the operation member 14 is provided with the opening portion 18C, and when the operation member 14 is brought to the closed position, as illustrated in FIGS. 1 and 2, an outer face 12C, facing in the +Z direction, of the housing 12 is exposed through the opening portion 18C. Thus, the outer face 12C of the housing 12 through the opening portion 18C can be used as a suction face to enable handling of the connector 11. By directly performing suction on the housing 12 instead of performing suction on the operation member 14 that is a movable member, stable handling can be achieved.

In the embodiment described above, the ceiling surface 15B of the insertion portion 15 forms an abutment surface, and the projections 23 abut the ceiling surface 15B of the insertion portion 15, whereby movement of the operation member 14 in the +Z direction is prohibited. However, even if an abutment surface is provided somewhere else on the housing 12 other than the ceiling surface 15B of the insertion portion 15, movement of the operation member 14 in the +Z direction can be similarly prohibited.

Moreover, in the embodiment described above, the operation member 14 includes the manipulation portion 18, and when the connection target 31 is pulled out from the connector 11, the operation member 14 can be rotated to the fully open position by lifting the manipulation portion 18. However, the manipulation portion 18 can be omitted from the operation member 14. In such case, it is necessary that the connection target 31 be pulled out from the connector 11 after the operation member 14 is rotated to the fully open position by means of a jig or like.

Furthermore, in the embodiment described above, the torque members 21 held by the housing 12 come into contact with the rotation shaft portion 19 to exert a torque on the operation member 14 such that the operation member 14 rotates from the open position to the closed position, whereby the connection target 31 is fitted with the connector 11 only by a single action of inserting the connection end portion 33 of the connection target 31 into the insertion portion 15. However, this is not the sole case. For example, instead of using the torque members 21, the manipulation portion 18 may be manipulated so that the operation member 14 is brought to the open position as illustrated in FIGS. 8A to 8D to insert the connection end portion 33 of the connection target 31 into the insertion portion 15, and subsequently the manipulation portion 18 may be manipulated so that the operation member 14 is brought to the closed position as illustrated in FIGS. 9A to 9D.

Even in this manner, the lock portions 22 are fitted in the cutouts 35 of the connection target 31 so that pull-out of the connection end portion 33 of the connection target 31 from the insertion portion 15 can be prohibited, while movement of the operation member 14 in the +Z direction can be prohibited since the projections 23 come into contact with or in vicinity of the ceiling surface 15B of the insertion portion 15.

In the case where the operation member 14 is rotated by not using the torque members 21 but manipulating the manipulation portion 18, when the operation member 14 is located at the closed position, the manipulation portion 18 is not required to extend in the insertion direction of the connection target 31, i.e., in the +Y direction, from the rotation shaft portion 19 and may extend in the pull-out direction of the connection target 31, i.e., in the −Y direction.

In the connector 11 according to the embodiment above, the first contacts 16 and the second contacts 17 are alternately arranged in the X direction. However, this is not the sole case, and contacts of only a single type can be arranged.

In addition, the number of contacts 13 in the connector 11 is not particularly limited as long as the number of contacts 13 corresponds to the number of electrodes 34 of the connection end portion 33 of the connection target 31.

In the embodiment described above, a plurality of electrodes 34 are formed and arranged on only the front surface, among the front and back surfaces, of the connection end portion 33 of the connection target 31. However, the electrodes 34 may be formed and arranged on each of the front and back surfaces of the connection end portion 33.

The connection target 31 is provided with the cutouts 35 as the lock receiving portions in which the lock portions 22 are fitted when fitting with the connector 11. However, lock receiving portions are not particularly limited to the cutouts 35, and through holes formed in the connection target 31, for example, can be used as the lock receiving portions.

The connection target 31 is not particularly limited to an FPC, and various connection targets including an FFC, a rigid circuit board or other printed wiring boards can be used.

What is claimed is:

1. A connector into which a connection end portion of a connection target that is provided with a lock receiving portion is inserted, comprising:

a housing including an insertion portion into which the connection end portion of the connection target is inserted, a shaft receiving portion having a recess-like shape and opening in an opening direction which crosses an insertion direction of the connection target and an abutment surface facing in an opposite direction from the opening direction of the shaft receiving portion, and an operation member including a rotation shaft portion to be inserted in the shaft receiving portion and being held by the housing rotatably around an axis direction of the rotation shaft portion, wherein the operation member includes a lock portion projecting in an orthogonal direction to the axis direction of the rotation shaft portion and a projection projecting in another orthogonal direction to the axis direction of the rotation shaft portion than the orthogonal direction in which the lock portion projects, wherein the connection end portion of the connection target is allowed to be inserted into or pulled out from the insertion portion when the operation member is located at an open position, and wherein, as the operation member is brought to a closed position while the connection end portion of the connection target is inserted in the insertion portion, the lock portion is fitted in the lock receiving portion of the connection target to prohibit pull-out of the connection end portion of the connection target from the insertion portion, and the projection comes into contact with or in vicinity of the abutment surface to prohibit movement of the operation member in the opening direction.

2. The connector according to claim 1, wherein the abutment surface is constituted of a ceiling surface of the insertion portion.

3. The connector according to claim 1, wherein the lock portion includes: a push-in surface opposing an insertion opening of the insertion portion when the operation member is located at the closed position; and a lock surface facing on an opposite side from the insertion opening of the insertion portion when the operation member is located at the closed position, and wherein, as the connection end portion of the connection target is inserted into the insertion portion while the operation member is located at the closed position, a tip end face of the connection end portion of the connection target comes into contact with the push-in surface and pushes the push-in surface in the insertion direction of the connection target to rotate the operation member toward the open position, and the lock portion is fitted in the lock receiving portion of the connection target, causing the operation member to return to the closed position to prohibit the pull-out of the connection end portion of the connection target from the insertion portion by the lock surface.

4. The connector according to claim 3, wherein, when the operation member is located at the closed position, an angle between the push-in surface and the insertion direction of the connection target is less than 90 degrees, and an angle between the lock surface and the insertion direction of the connection target is not smaller than 90 degrees.

5. The connector according to claim 3, further comprising a torque member held by the housing and exerting a torque on the operation member such that the operation member rotates from the open position toward the closed position.

6. The connector according to claim 1, wherein the lock portion and the projection are integrated as a single metal component.

7. The connector according to claim 1, wherein the operation member includes a manipulation portion extending in the insertion direction of the connection target when the operation member is located at the closed position.

8. The connector according to claim 7, wherein the manipulation portion includes an opening portion, and when the operation member is located at the closed position, an outer face of the housing exposed through the opening portion forms a suction face to perform suction of the connector.

9. The connector according to claim 1, wherein the operation member is held by the housing so as to be rotatable to a fully open position that is farther opposite from the closed position than the open position, and wherein, when the operation member is located at the fully open position, a part of the projection projects inside the insertion portion so as to prohibit insertion of the connection end portion of the connection target into the insertion portion.

10. The connector according to claim 9, wherein the shaft receiving portion includes a bottom portion that is flat and extends in the insertion direction of the connection target, and wherein the rotation shaft portion includes a flat portion that comes into contact with the bottom portion of the shaft receiving portion when the operation member is located at the fully open position.

* * * * *